US006851336B2

(12) United States Patent
Yu

(10) Patent No.: US 6,851,336 B2
(45) Date of Patent: Feb. 8, 2005

(54) ENCLOSED WRENCH

(76) Inventor: Hsiang-Chen Yu, No. 22, Lane 300, Ci De Rd., Tali City, Taichung Hsien (TW)

( * ) Notice: Subject to any disclaimer, the term of this patent is extended or adjusted under 35 U.S.C. 154(b) by 28 days.

(21) Appl. No.: 10/406,906

(22) Filed: Apr. 3, 2003

(65) Prior Publication Data

US 2004/0194586 A1 Oct. 7, 2004

(51) Int. Cl.[7] ..... B25B 13/00
(52) U.S. Cl. ..... 81/124.3
(58) Field of Search ..... 81/121.1, 124.3, 81/124.7, 186

(56) References Cited

U.S. PATENT DOCUMENTS 3,903,764 A * 9/1975 Andersen ..... 81/121.1
4,100,824 A * 7/1978 Marschke ..... 81/124.6
5,865,074 A * 2/1999 Hsieh ..... 81/124.3

* cited by examiner

*Primary Examiner*—Derris H. Banks
*Assistant Examiner*—J Williams
(74) *Attorney, Agent, or Firm*—Charles E. Baxley

(57) ABSTRACT

An enclosed wrench has a drive head defined at an end provided with an opening therein, on the internal surface of the opening a plurality of uniform drive protrusions being disposed respectively and each of which is isosceles triangle structure, the sidelines of each adjacent pair of drive protrusion are crossed. A vertex of each drive protrusion is identical with that of a vertex of the respective isosceles triangle. The height of the isosceles triangle is equal to the sum of the absolute value of the international tolerance of the wrench and that of the corresponding working piece to be driven.

3 Claims, 15 Drawing Sheets

ENCLOSED WRENCH

BACKGROUND OF THE INVENTION

1. Field of the Invention

The present invention relates to an enclosed wrench, and more particularly to such a wrench having an ability of reducing the sum of tolerance of the wrench and that of a working piece (such as bolts and nuts) to be driven (namely reducing the clearance between the wrench and the working piece to be driven), furthermore, which is capable of driving the deteriorating working pieces.

2. Description of the Prior Arts

A conventional enclosed wrench 10 (here takes a multi-point box-end wrench as example as shown in FIG. 1) has a drive head 11 defined at an end. On the internal surface of the drive head 11 a plurality of drive protrusions 13 are disposed, the drive head 11 serves to engage with the working piece to be driven the drive protrusions 13 confining the same. However, there are some disadvantages will be caused in real operation as follows:

First, as shown in FIG. 2, an enlarged view of quarter of the FIG. 1, the key structure of the conventional wrench 10 is that a predetermined number of tangent points 14, turning points 15 and arcs 16 should be disposed on the internal surface 12 of the drive head 11. However, the locations of the respective tangent points 14, turning points 15 and arcs 16 only can be figured out by complicated calculations, thereby caused difficulties in production.

Second, as shown in FIG. 3, another conventional wrench 20 is shown having a drive head 21 engaged with a corresponding sized working piece 22, in case of rather great clearances existing between the drive protrusions 23 of the wrench 20 and the respective side surfaces 24 of the working piece 22 to be driven that is deteriorating engagement, thereby the wrench 20 or the working piece 22 even maybe both of them will be spoiled during operation. If turns the wrench 20 by force, (as shown in FIG. 4), then the working piece 22 will be deformed and may not be driven. However, the wrench 20 is inapplicable to the deteriorating working piece 22, such that inconveniences are caused.

The present invention has arisen to mitigate and/or obviate the afore-described disadvantages of the conventional enclosed wrench.

SUMMARY OF THE INVENTION

In accordance with one aspect of the present invention there is provided an enclosed wrench having a drive head defined at an end provided with an opening therein, on the internal surface of the opening a plurality of uniform drive protrusions are disposed respectively and each of which is isosceles triangle structure, the sidelines of each adjacent pair of drive protrusions are crossed, a vertex of each drive protrusion is identical with that of a vertex of the respective isosceles triangle, the height of the isosceles triangle is equal to the sum of the absolute value international tolerance of the wrench and that of the corresponding working piece to be driven. In addition, at least an anti-skid tooth is defined at each of the two drive surfaces of the corresponding drive protrusion. The anti-skid tooth has contacting surface corresponding to the object to be driven. The contacting surface is flush with the drive surface of the corresponding drive protrusion.

The primary objective of the present invention is to provide an enclosed wrench, in which, the each drive protrusions may be configured without complicated calculation so as to simplify the forming process, moreover, the spoilage of the working piece to be driven can be avoided.

The further objective of the present invention is to provide an enclosed wrench having an ability of driving the deteriorating working pieces and preventing the slippage happened in operation.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
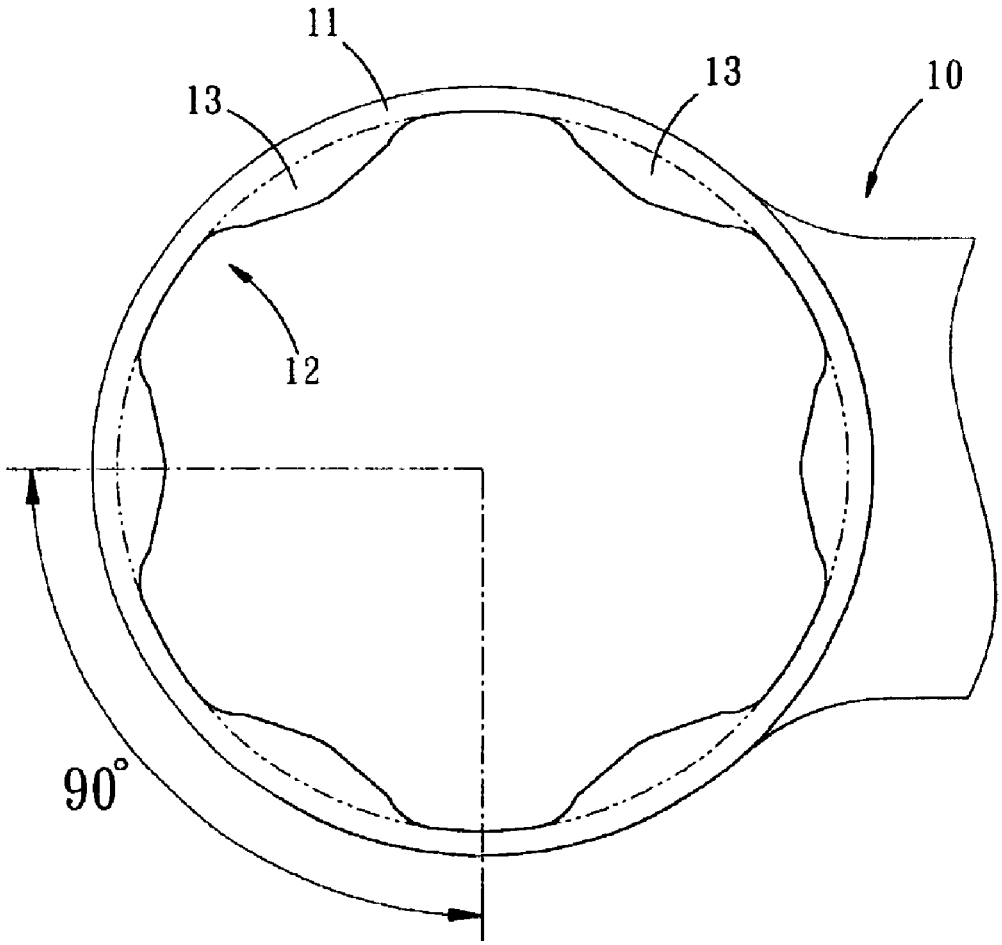
FIG. 1 PRIOR ART
FIG. 1 is top plan view of a conventional wrench.
Figure 2:
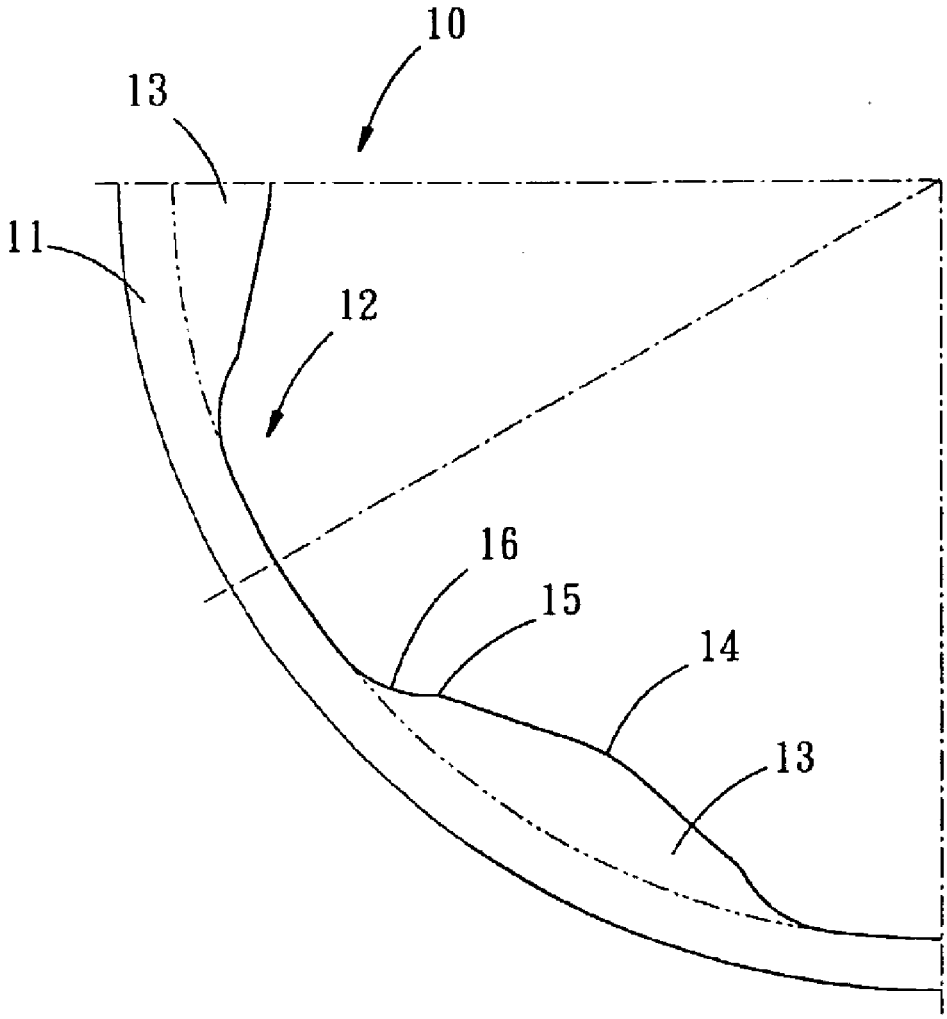
FIG. 2 PRIOR ART
FIG. 2 is an enlarged view of quarter of the FIG. 1.
Figure 3:
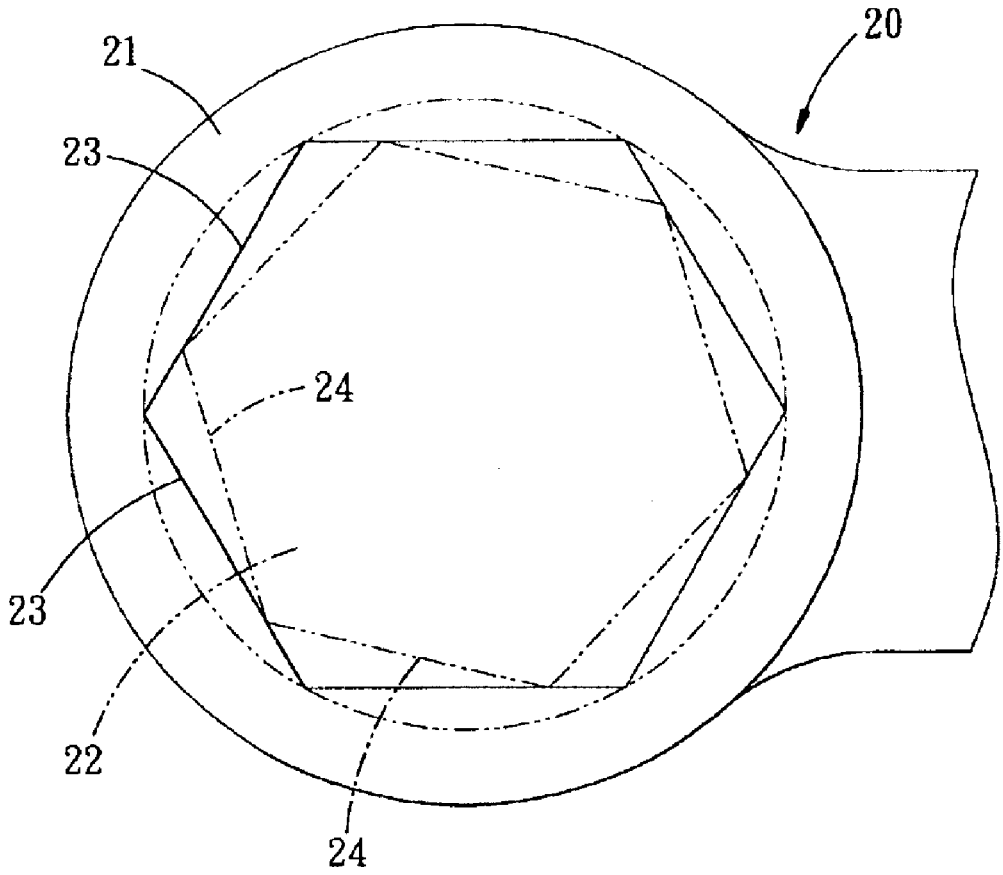
FIG. 3 PRIOR ART
FIG. 3 is a top plan view of another conventional wrench and a working piece being driven is shown in dotted line.
Figure 4:
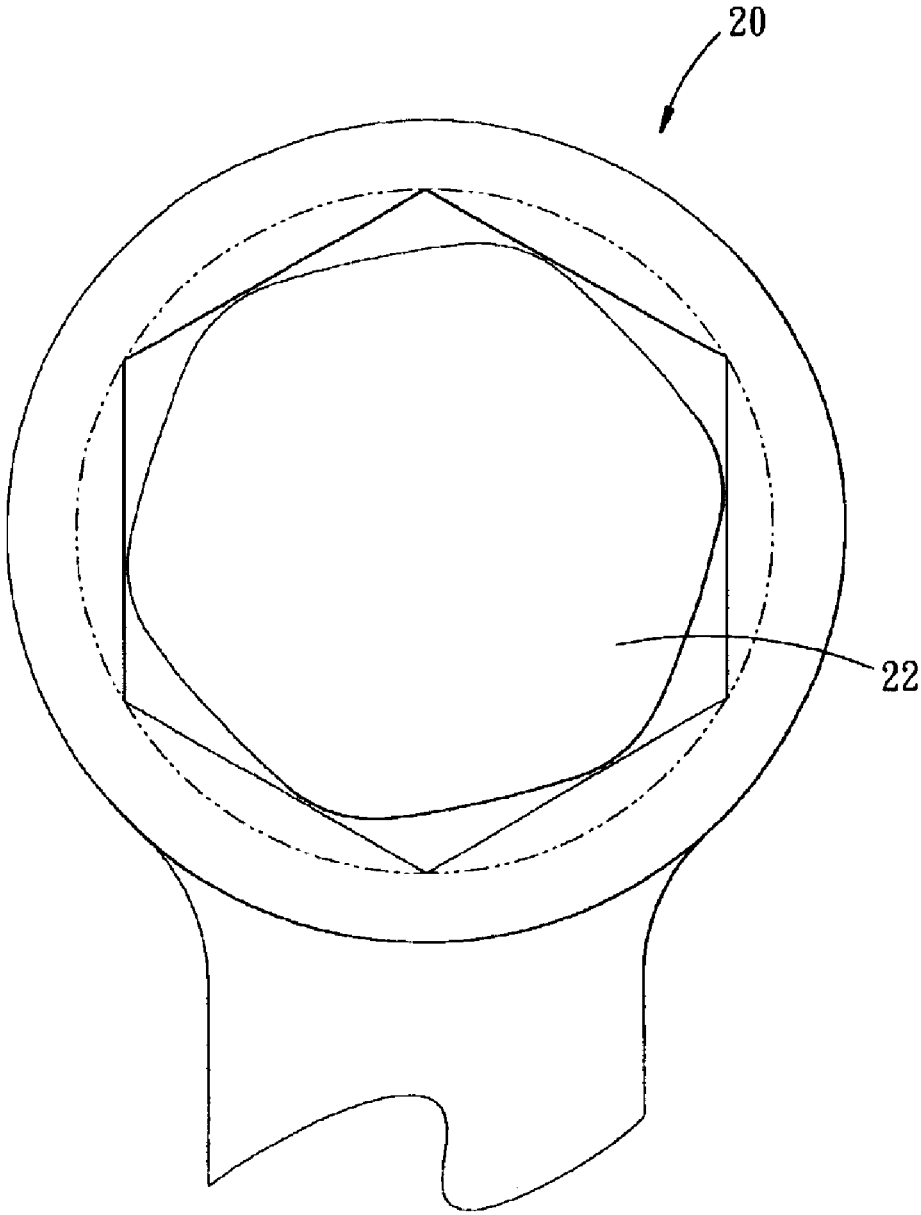
FIG. 4 PRIOR ART
FIG. 4 is a top plan view of another conventional wrench showing a deteriorating working piece being driven.
Figure 5:
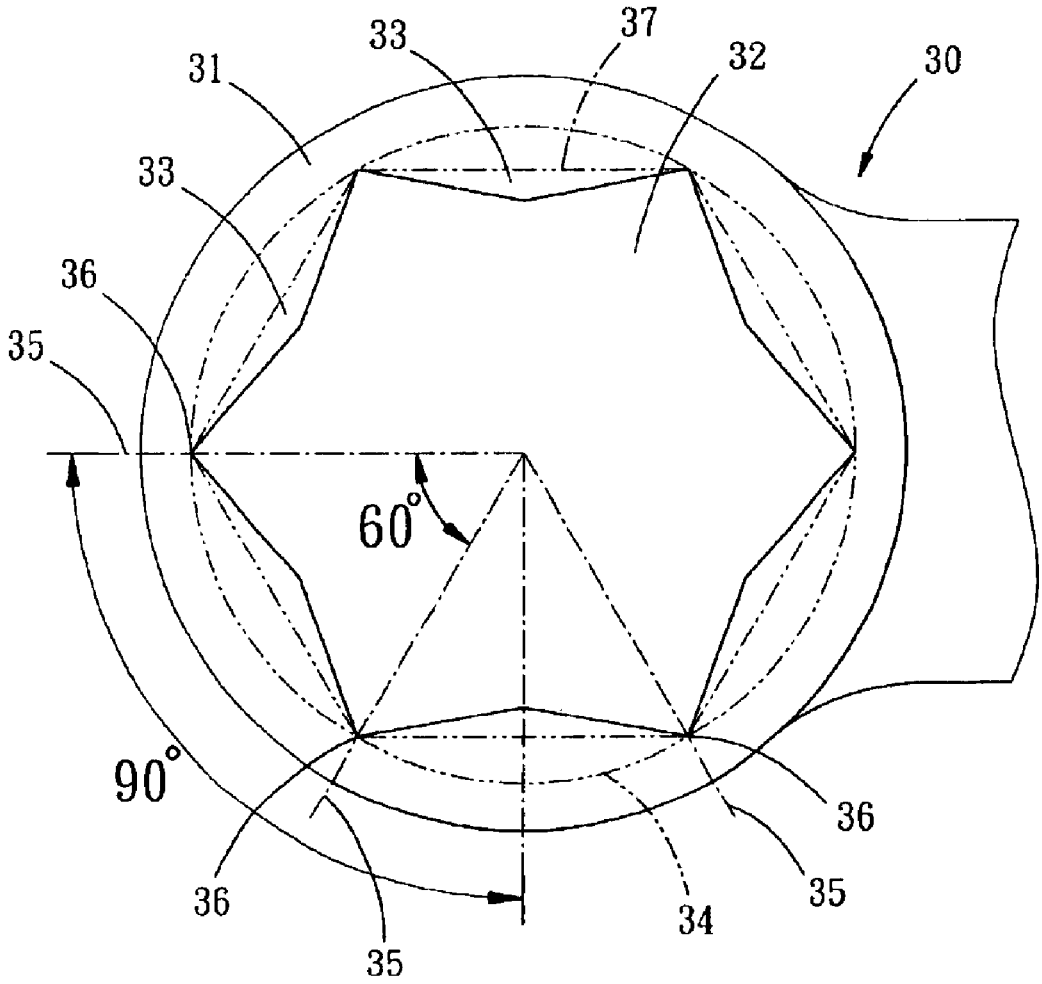
FIG. 5 is a top plan view of an enclosed wrench in accordance with a first embodiment of the present invention.

Referring to FIG. 5, an enclosed wrench 30 in accordance with a first embodiment of the present invention is shown, in which, a drive head 31 is provided at an end of the wrench 30. The drive head 31 has an opening 32 defined thereof, on the internal side of the opening 32 sextuple uniform drive protrusions 33 are disposed respectively and each of which is isosceles triangle structure (a plurality of drive protrusions 33 may be provided in accordance with the present invention). The vertex of each drive protrusion 33 is identical with that of the respective isosceles triangle. Moreover, the height of the isosceles triangle is equal to the sum of the absolute value of the international tolerance of the wrench 30 and that of the corresponding working piece to be driven.

Still referring to FIG. 5, wherein a dotted circle 34 is designated on the drive head 31 of the wrench 30 with the opening 32 enclosed therein. While the imaginary circle 34 is divided into sextuple uniform segments of 60 degree for each, each bisector 35 intersects the dotted circle 34 at six intersection points 36 respectively. A sideline 37 connects each adjacent pair of the intersection points 36.

Figure 6:
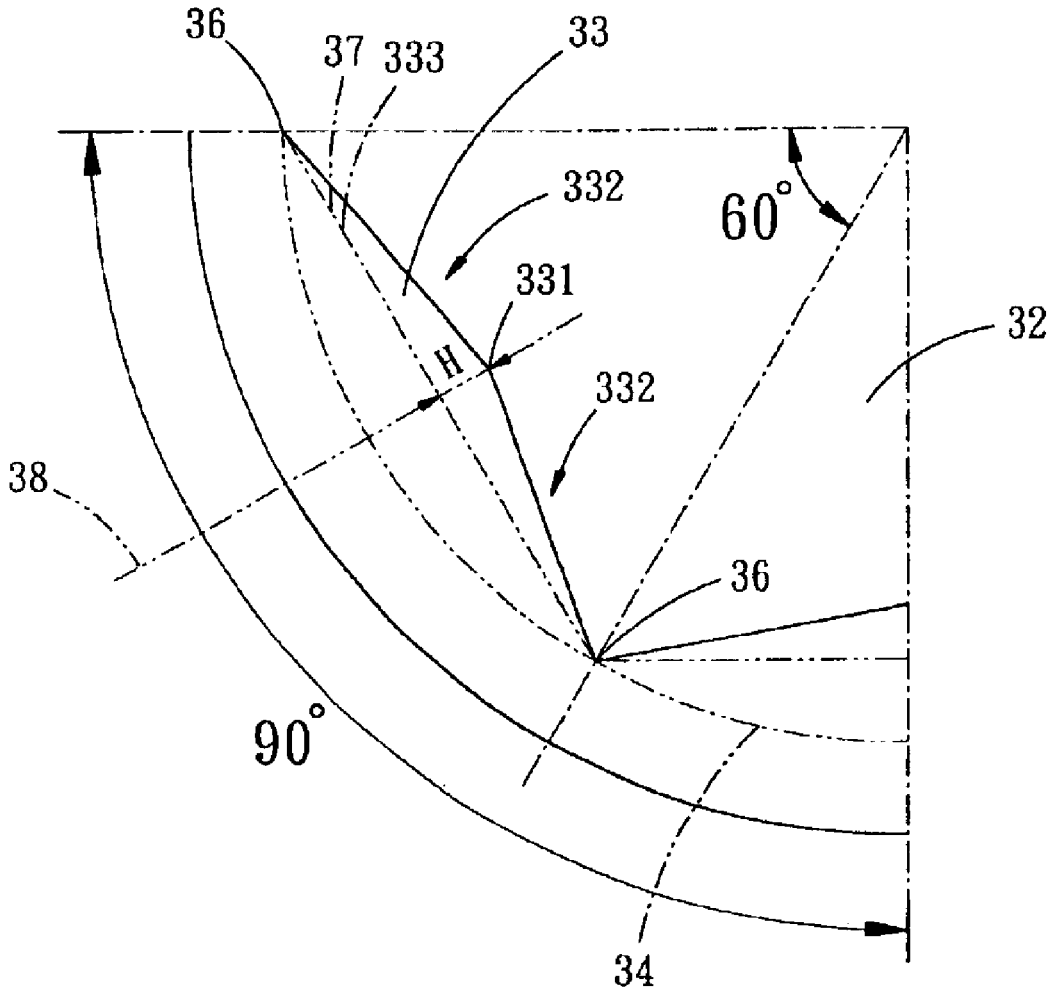
FIG. 6 is an enlarged view of quarter of the FIG. 5.

Referring further to FIG. 6, which is an enlarged view of the quarter of the FIG. 5, in which, the vertex 331 of each drive protrusions 33 locates on the vertical bisector 38 of the corresponding sidelines 37, while by linking the same with the corresponding intersection points 36 forms the drive surfaces 332, furthermore, the baseline 333 of each drive protrusions 33 is identical to the each corresponding sideline 37 of the imaginary circle 34. Suppose the vertical distance between the vertex 331 and the corresponding baseline 333 of each drive protrusion 33 is "H".

Figure 7:
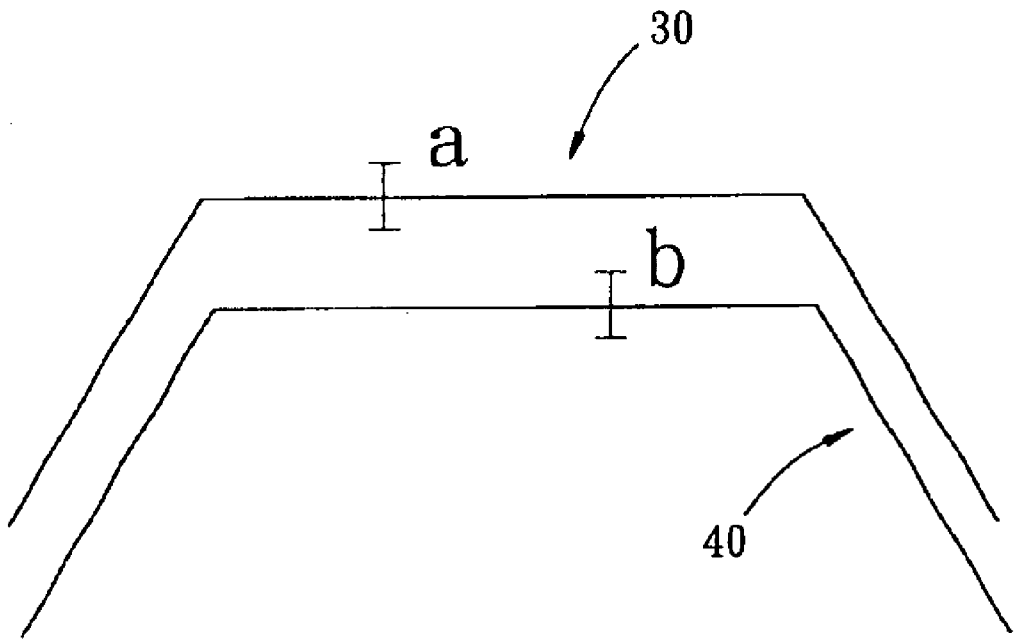
FIG. 7 is a partial plan view of the enclosed wrench in accordance with the first embodiment of the present invention.

Referring to FIG. 7, wherein the relationship between the wrench 30 and the vertical distance H is: "H" is the sum of the absolute value of "a" of the international tolerance applied standard of the wrench 30 and that the absolute value of "b" of the corresponding working piece 40 to be driven, that is $H=|a|+|b|$. Wherein the amount of the tolerances of the wrench 30 and the corresponding working piece 40 will vary from the sizes of the same, while the wrench 30 and the working piece 40 can be found the corresponding standards (specification) in the table of international tolerance. In other words, during production, there is an international standard on the specification of the wrench 30, while each specification has a certain tolerance. Only the wrench 30 is qualified which error of specification after being processed falls in the range of the tolerance, "a" is the right tolerance of the wrench 30. And alike, there is an international standard on the specification of the working piece 40 during production, while each specification has a certain tolerance. Only the working piece 40 is qualified which error of specification after being processed falls in the range of the tolerance, "b" is the right tolerance of the working piece 40.

The enclosed wrench in accordance with the present invention at least possesses the advantages as follows:

First, the each drive protrusions of the wrench may be configured without complicated calculation so as to simplify the forming process.

Figure 8:
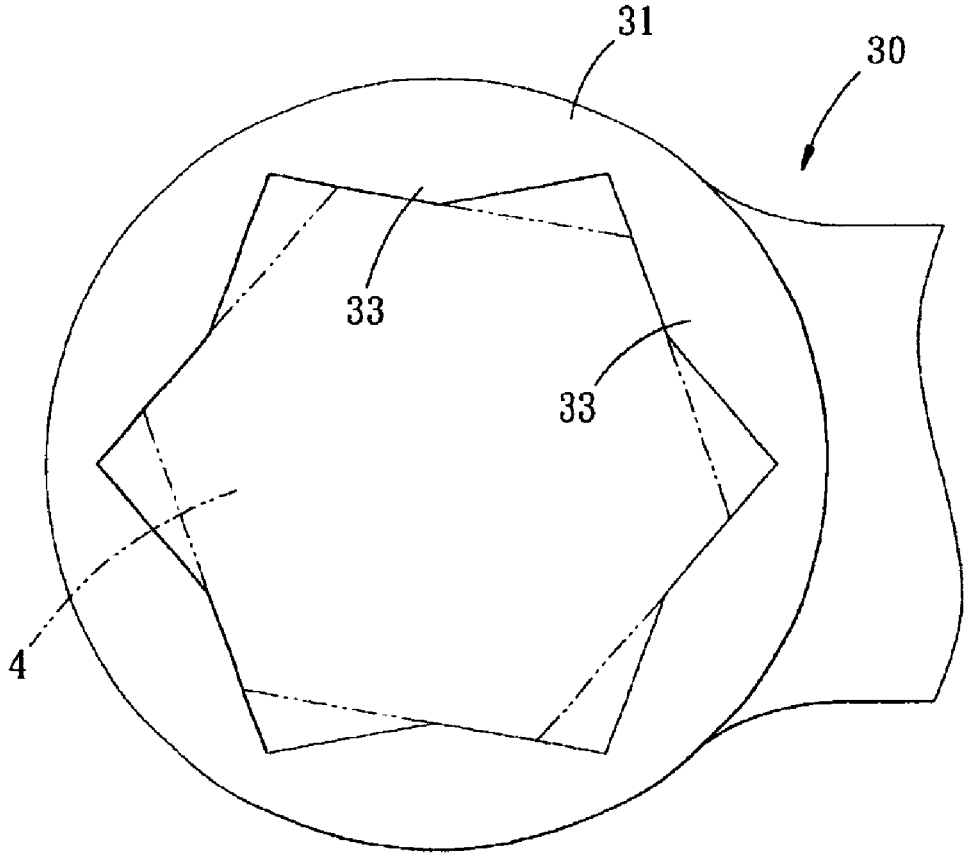
FIG. 8 is a top plan view of the enclosed wrench in accordance with the first embodiment of the present invention and a working piece being driven is designated by dotted line.

Second, as shown in FIG. 8, in which, the wrench 30 of the present invention is engaged with the working piece 40 via the drive head 31. Due to the clearances between the respective drive protrusions 33 and the corresponding side surfaces of the working piece 40 have been reduced to a certain extent, deteriorating engagement and spoilage will be avoided in case that the drive protrusions of 33 of the wrench 30 are engaged with the working piece 40 and rotated.

Figure 9:
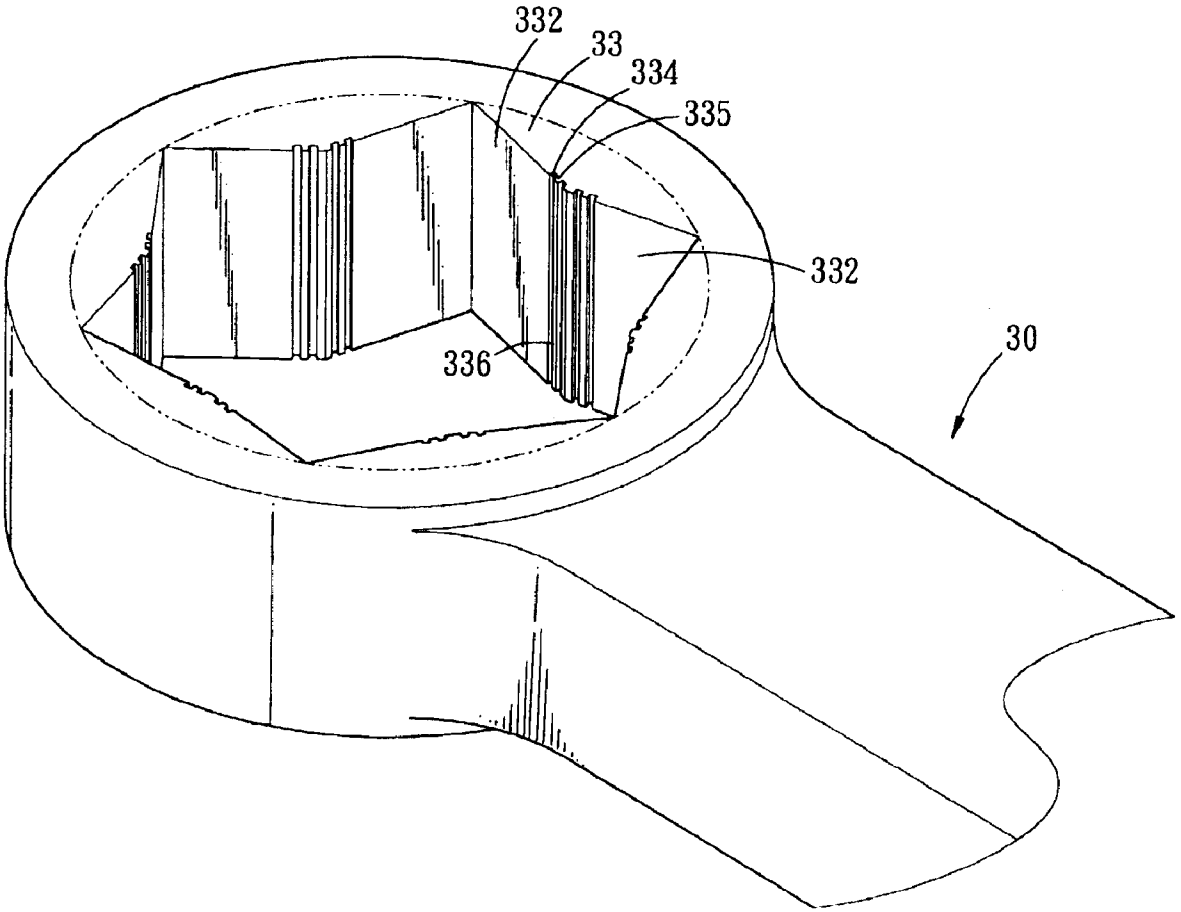
FIG. 9 is a perspective view of an enclosed wrench in accordance with a second embodiment of the present invention.
Figure 10:
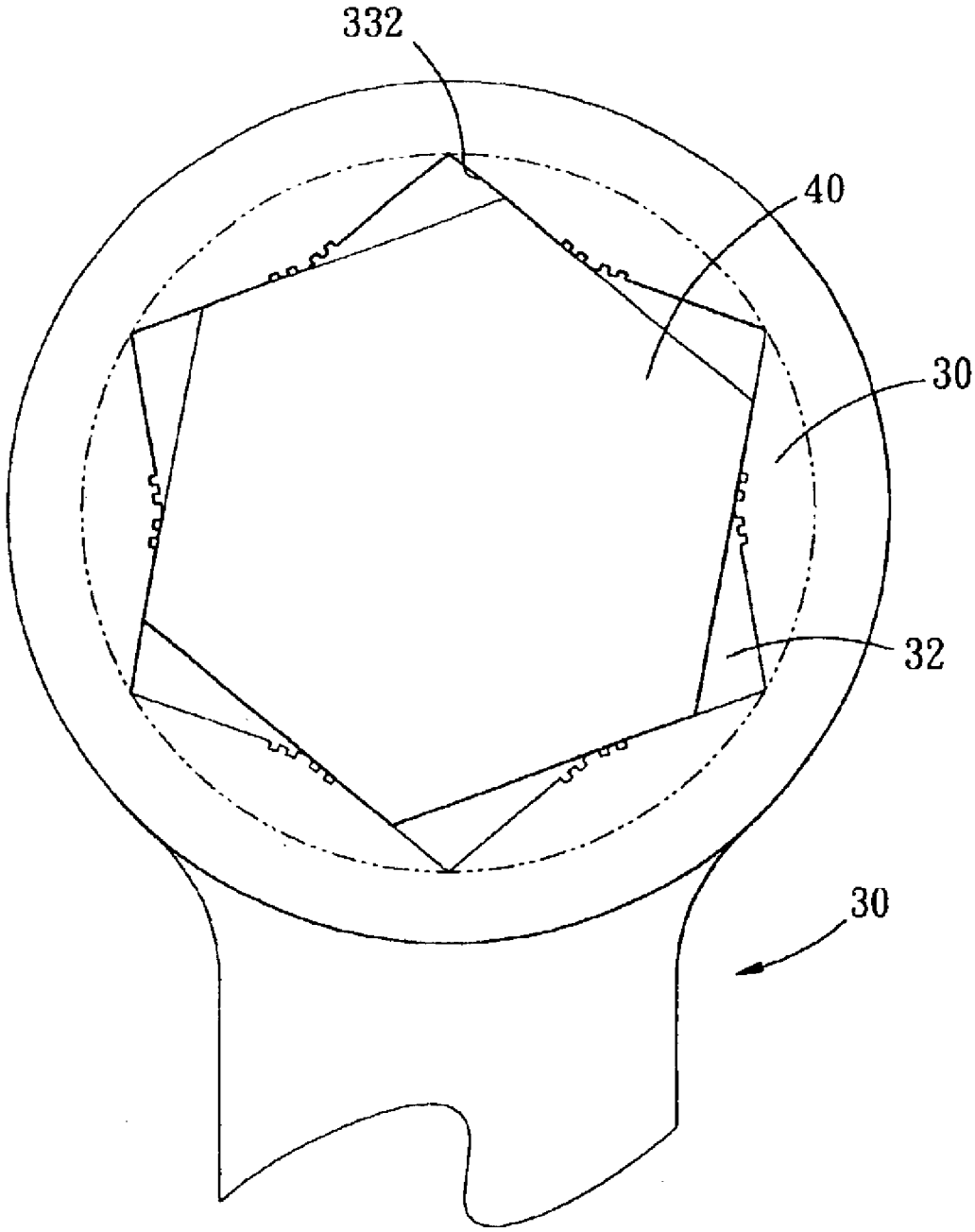
FIG. 10 is a top plan view of the enclosed wrench in accordance with the second embodiment of the present invention and an intact working piece being driven.

Referring now to FIG. 9, in which, a wrench 30 in accordance with a second embodiment of the present invention is shown. The differences between the first and second embodiment of the present invention are: each drive projections 33 are provided with a pair of notches 334 in the corresponding drive surfaces 332 of it, between the paired notches 334 an anti-skid tooth 335 is defined, which has a contacting surface 336 in corresponding to the working piece to be driven. Each contacting surfaces 336 are plane formed and flush with the drive surfaces 332 of the corresponding drive protrusions 33 respectively. By such a manner, the wrench 30 of the second embodiment of the present invention is applicable to the following two statuses:

First, as shown in FIG. 10, the opening 32 of the enclosed wrench 30 is engaged with a working piece 40 which is not deteriorated, and then the screwing or unscrewing operation can be executed by virtue of the drive surfaces 332 of the respective drive protrusions 33 snugly engaging with the periphery of the working piece 40.

Figure 11:
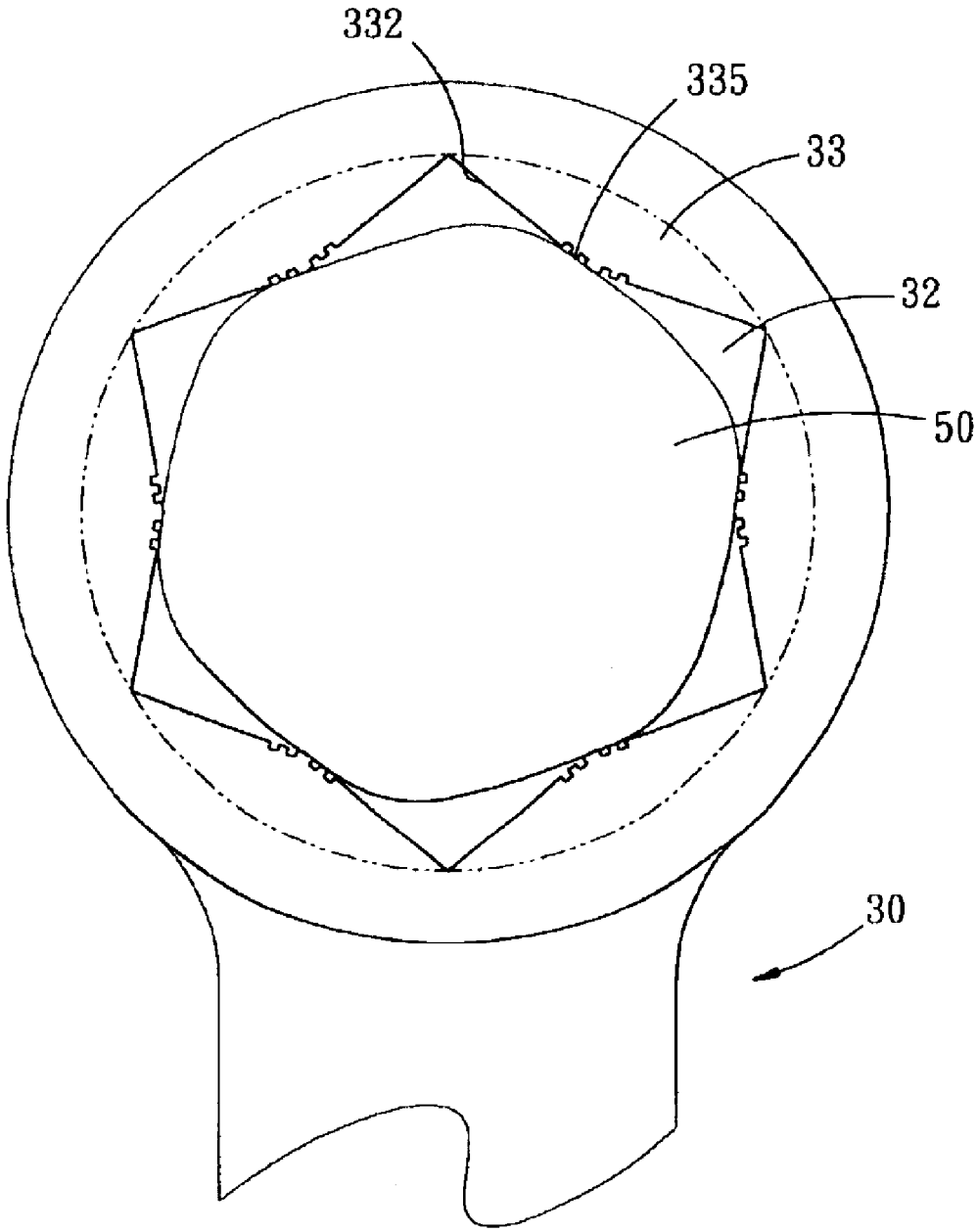
FIG. 11 is a top plan view of the enclosed wrench in accordance with the second embodiment of the present invention and a deteriorating working piece being driven.
Figure 12:
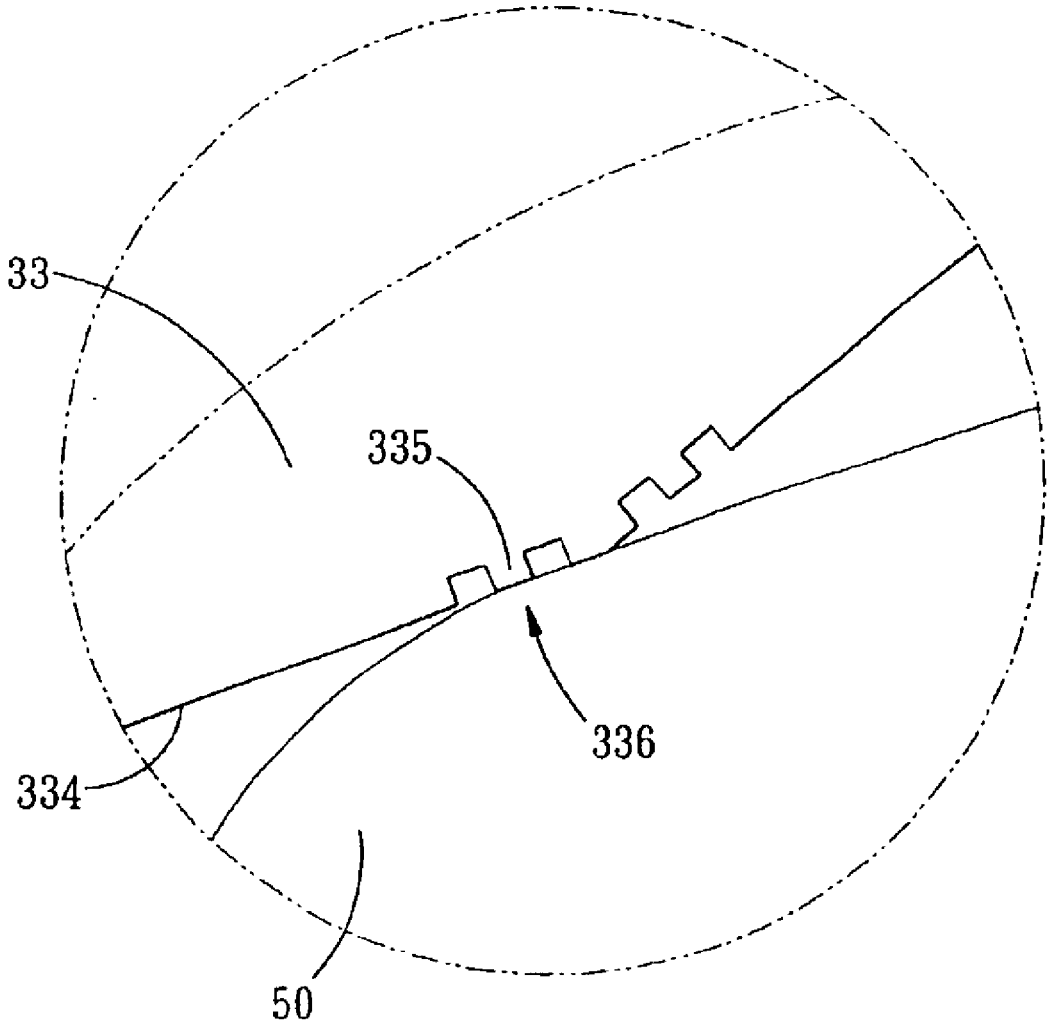
FIG. 12 is an enlarged view of partial of FIG. 11.

Second, as shown in FIGS. 11–12, the opening 32 of the enclosed wrench 30 is engaged with a deteriorating working piece 50, and then the screwing or unscrewing operation can be executed by virtue of the drive surfaces 332 of the respective drive protrusions 33 together with the contacting surfaces 336 of the anti-skid teeth 335 in the corresponding drive protrusions 334 snugly engaging with the periphery of the deteriorating working piece 50.

Figure 13:
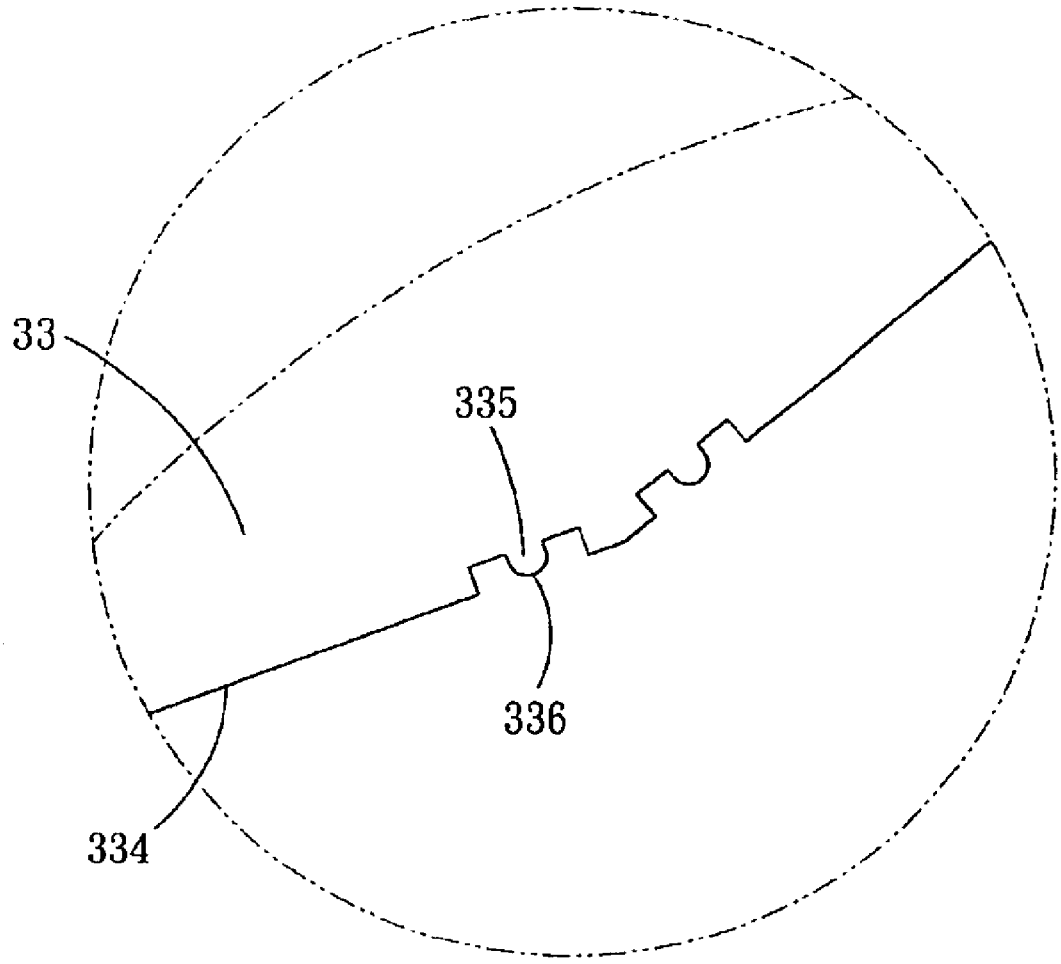
FIG. 13 is an enlarged view of showing the arc teeth of the enclosed wrench of the second embodiment of the present invention.
Figure 14:
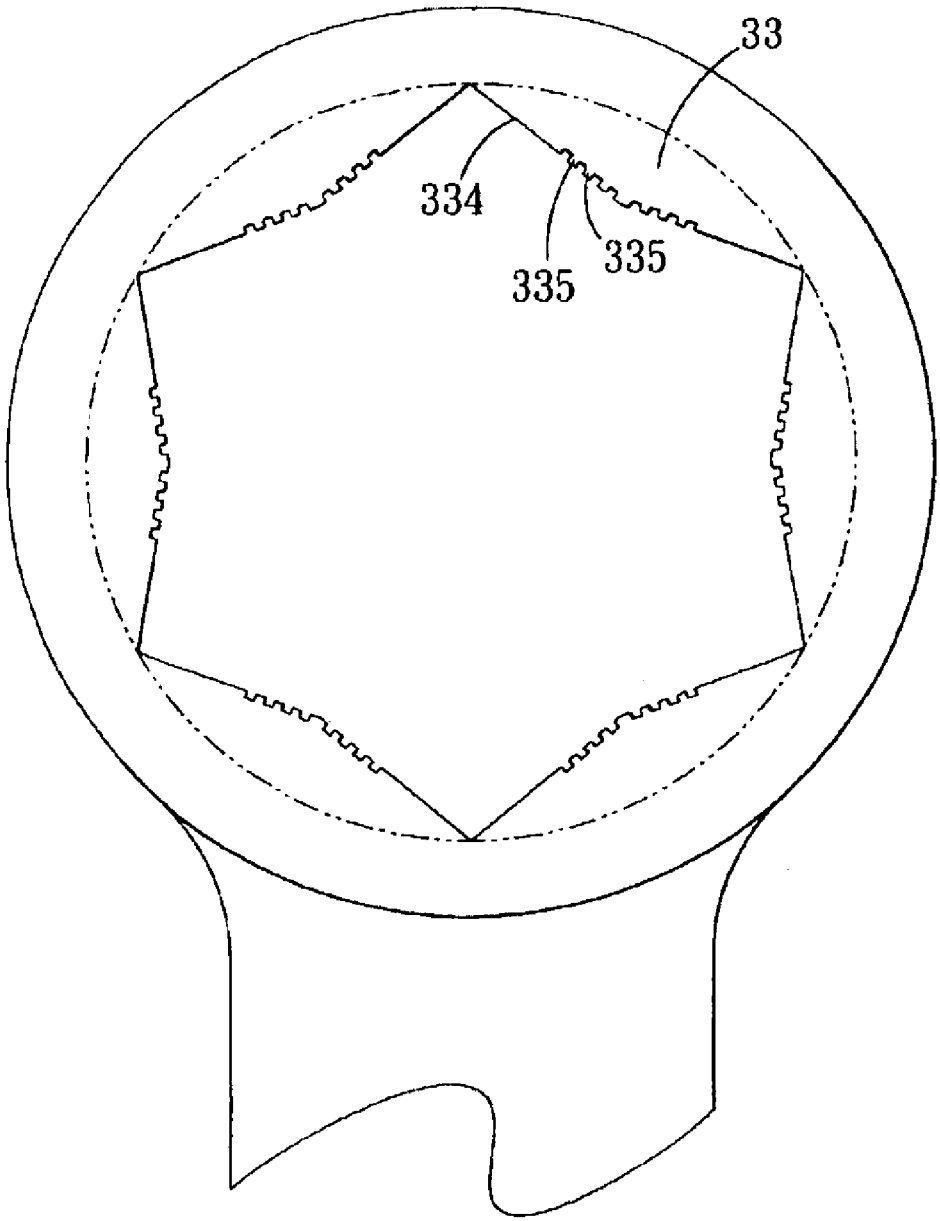
FIG. 14 is a top plan view of the enclosed wrench of the second embodiment of the present invention that provided with three anti-skid teeth.

On the other hand, as shown in FIG. 13, the contacting surface 336 of each anti-skid tooth 335 in accordance with the second embodiment of the present invention can be arc constructed, which is also applicable to the deteriorating working piece to be driven. In addition, as shown in FIG. 14, in accordance with the present invention that each drive surface 332 of the drive protrusions 33 can be provided with three pieces of anti-skid teeth 335.

Figure 15:
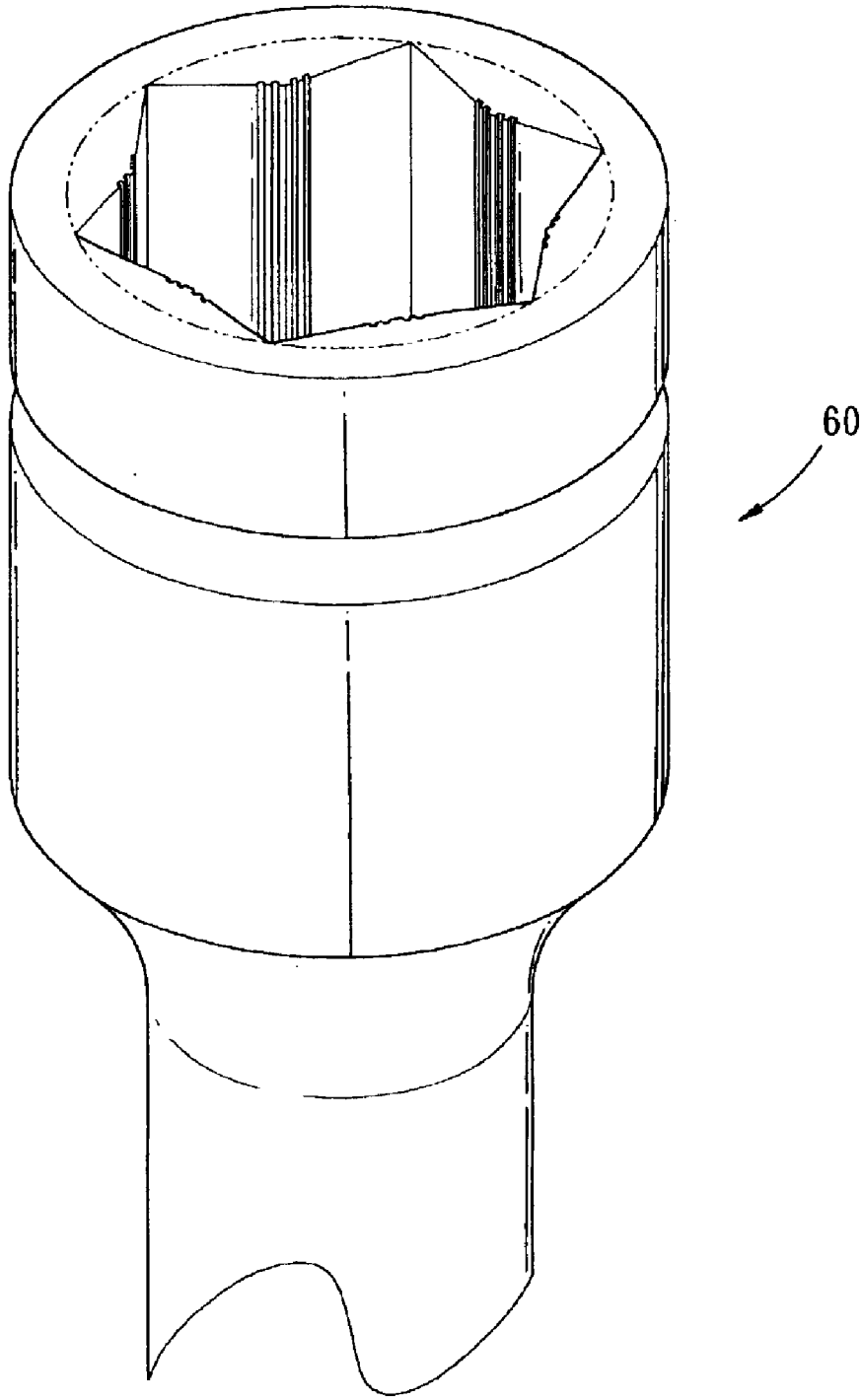
FIG. 15 is a perspective view of a socket wrench in accordance with the present invention.

Finally, as shown in FIG. 15, the structure of the present invention may be applied to socket wrench 60, and alike, which possesses the same advantages and effects so as to be another embodiment of the present invention.

While we have shown and described various embodiments in accordance with the present invention, it should be clear to those skilled in the art that further embodiment may be made without departing from the scope of the present invention.

What is claimed is:

1. An enclosed wrench comprising a drive head defined at an end provided with an opening therein, on the internal surface of the opening a plurality of uniform drive protrusions being disposed respectively and each of which is isosceles triangle structure, sidelines of each adjacent pair of drive protrusion being crossed, a vertex of each drive protrusion being identical with that of a vertex of the respective isosceles triangle, the height of the isosceles triangle being equal to the sum of the absolute value of the international tolerance of the wrench and that of the corresponding working piece to be driven.

2. An enclosed wrench comprising a drive head defined at an end provided with an opening therein, on the internal surface of the opening a plurality of drive protrusions are defined and each drive protrusions being triangle structure, at least an anti-skid tooth defined at each of the two drive surfaces of the corresponding drive protrusion, the anti-skid tooth having contacting surface corresponding to the working piece to be driven, the contacting surface being flush with the drive surface of the corresponding drive protrusion whereby to cooperate with the deteriorating working piece to be driven;

wherein the contacting surface of the each anti-skid tooth is plane configured.

3. The enclosed wrench as claimed in claim 1, wherein the quantity of the drive protrusion of the wrench is six.

* * * * *

US006851336C1

(12) EX PARTE REEXAMINATION CERTIFICATE (7053rd)

United States Patent

Yu

(10) Number: US 6,851,336 C1

(45) Certificate Issued: Sep. 8, 2009

(54) ENCLOSED WRENCH

(76) Inventor: Hsiang-Chen Yu, No. 22, Lane 300, Ci De Rd., Tali City, Taichung Hsien (TW)

Reexamination Request:
No. 90/010,247, Dec. 3, 2008

Reexamination Certificate for:

| | |
|---|---|
| Patent No.: | **6,851,336** |
| Issued: | **Feb. 8, 2005** |
| Appl. No.: | **10/406,906** |
| Filed: | **Apr. 3, 2003** |

(51) Int. Cl.
*B25B 13/00* (2006.01)

(52) U.S. Cl. ..... 81/124.3

(58) Field of Classification Search ..... None
See application file for complete search history.

(56) References Cited

U.S. PATENT DOCUMENTS

| | | | |
|---|---|---|---|
| 3,903,764 A | 9/1975 | Andersen | |
| 4,765,211 A | 8/1988 | Colvin | |
| 5,388,486 A | 2/1995 | Ruzicka et al. | |
| 5,832,792 A | 11/1998 | Hsieh | |

FOREIGN PATENT DOCUMENTS

| | | | |
|---|---|---|---|
| JP | 406604 | * | 9/2000 |
| TW | 310646 | | 7/1997 |
| TW | 381525 | | 2/2000 |
| TW | 423355 | | 2/2001 |

* cited by examiner

*Primary Examiner*—Aaron J. Lewis

(57) ABSTRACT

An enclosed wrench has a drive head defined at an end provided with an opening therein, on the internal surface of the opening a plurality of uniform drive protrusions being disposed respectively and each of which is isosceles triangle structure, the sidelines of each adjacent pair of drive protrusion are crossed. A vertex of each drive protrusion is identical with that of a vertex of the respective isosceles triangle. The height of the isosceles triangle is equal to the sum of the absolute value of the international tolerance of the wrench and that of the corresponding working piece to be driven.

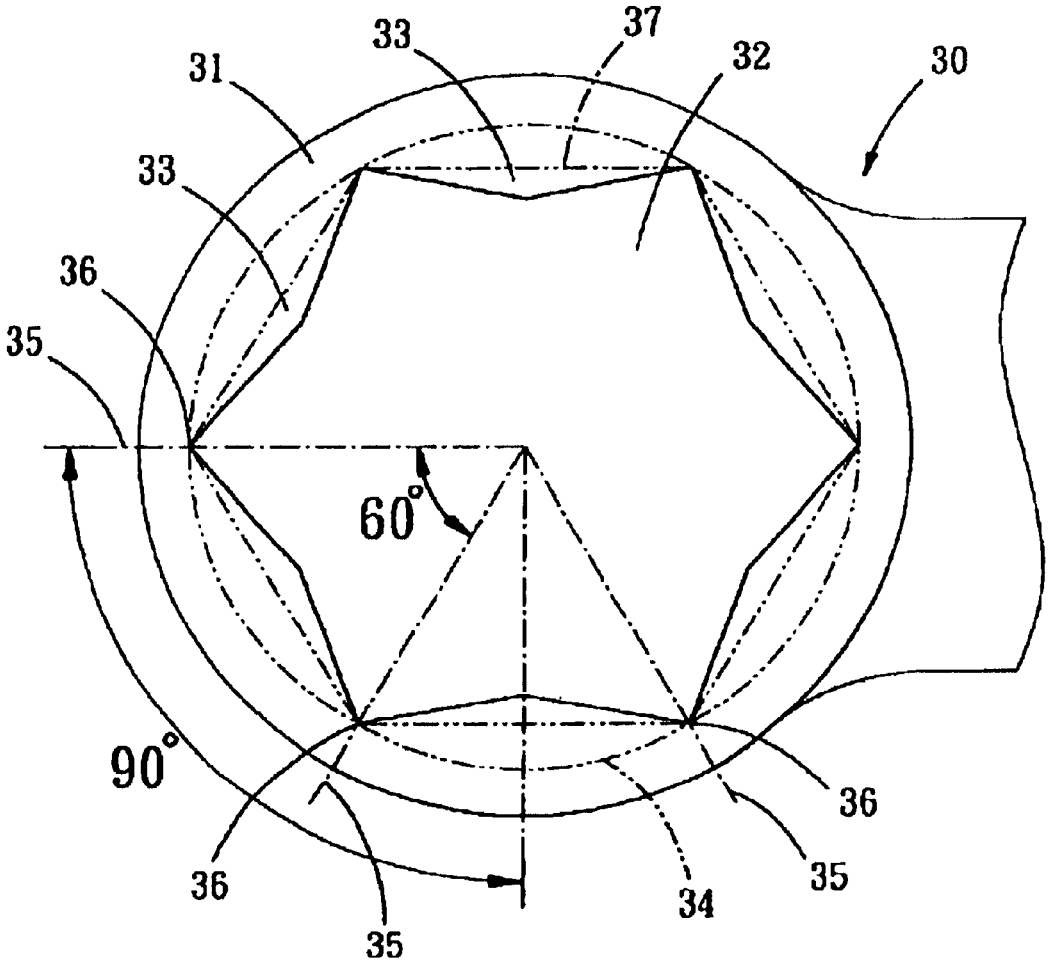

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 3 are cancelled.

Claim 1 is determined to be patentable as amended.

1. An enclosed wrench comprising a drive head defined at an end provided with an opening therein, on [the] *an* internal surface of the opening a plurality of uniform drive protrusions being disposed respectively and each of which is *an* isosceles triangle structure, sidelines of each adjacent pair of drive protrusion being crossed, a vertex of each drive protrusion being identical with that of a vertex of the respective isosceles triangle, [the] *a* height of the isosceles triangle being equal to [the ] *a* sum of [the] *an* absolute value of [the] *an* international tolerance of [the] *a* wrench and that of [the] *a* corresponding working piece to be driven.

* * * * *